US005363902A

United States Patent [19]

Kush

[11] Patent Number: 5,363,902

[45] Date of Patent: Nov. 15, 1994

[54] CONTAINED QUENCH SYSTEM FOR CONTROLLED COOLING OF CONTINUOUS WEB

[75] Inventor: Donald C. Kush, Pleasanton, Calif.

[73] Assignee: Kaiser Aluminum & Chemical Corporation, Pleasanton, Calif.

[21] Appl. No.: 998,675

[22] Filed: Dec. 31, 1992

[51] Int. Cl.[5] ..... B22D 11/06

[52] U.S. Cl. ..... 164/485; 164/481; 164/432; 164/443

[58] Field of Search ..... 164/485, 486, 443, 444, 164/479, 481, 429, 431, 432

[56] References Cited

U.S. PATENT DOCUMENTS

| | | | |
|---|---|---|---|
| 3,865,176 | 2/1975 | Dompas et al. | 164/481 |
| 4,679,611 | 7/1987 | Yoshida | 164/443 |
| 4,895,202 | 1/1990 | Sato | 164/481 |
| 4,905,753 | 3/1990 | Shio et al. | 164/432 |

FOREIGN PATENT DOCUMENTS

| | | | |
|---|---|---|---|
| 59-64147 | 4/1984 | Japan | 164/432 |
| 61-176448 | 8/1986 | Japan | 164/481 |
| 61-279341 | 12/1986 | Japan | 164/443 |
| 62-81250 | 4/1987 | Japan | 164/486 |
| 1-40150 | 2/1989 | Japan | 164/485 |
| 2-30354 | 1/1990 | Japan | 164/485 |
| 2274353 | 11/1990 | Japan | 164/486 |

*Primary Examiner*—P. Austin Bradley
*Assistant Examiner*—Erik R. Puknys
*Attorney, Agent, or Firm*—Rockey, Rifkin and Ryther

[57] ABSTRACT

A method and apparatus for continuously cooling a moving web while simultaneously removing the cooling fluid from the web in which a stream of quenching fluid is applied transversely across the web to cool it and a fluid containment gas is positioned on either side of the quenching fluid to direct a containment fluid toward the quenching fluid and establish a continuous containment fluid curtain stream to prevent passage of the quenching fluid beyond the point of which the containment fluid is introduced.

18 Claims, 5 Drawing Sheets

CONTAINED QUENCH SYSTEM FOR CONTROLLED COOLING OF CONTINUOUS WEB

BACKGROUND OF THE INVENTION

This invention relates to a method and apparatus for continuously cooling a moving web, and particularly to a method and apparatus for strip casting of metals in which an endless belt is cooled in a manner to improve the quality of the metal cast.

The continuous casting of thin metal strip has been employed with only limited success. By and large, prior processes for the continuous casting of metal strip have been limited to a relatively small number of alloys and products. It has been found that as the alloy content of various metals are increased, as-cast surface quality deteriorates. As a result, many alloys must be fabricated using ingot methods.

In the case of aluminum, relatively pure aluminum product such as foil can be continuously strip cast on a commercial basis. Building products can likewise be continuously strip cast, principally because surface quality in the case of such building products is less critical than in other aluminum products, such as can stock. However, as the alloy content of aluminum is increased, surface quality problems appear, and strip casting has generally been unsuitable for use in making many aluminum alloy products.

A number of strip casting machines have been proposed in the prior art. One conventional device is a twin belt strip casting machine, but such machines have not achieved widespread acceptance in the casting of many metals, and particularly metal alloys with wide freezing ranges. In such twin belt strip casting equipment, two moving belts are provided which define between them a moving mold for the metal to be cast. Cooling of the belts is typically effected by contacting a cooling fluid with the side of the belt opposite the side in contact with the molten metal. As a result, the belt is subjected to extremely high thermal gradients, with molten metal in contact with the belt on one side and a water coolant, for example, in contact with the belt on the other side. The dynamically unstable thermal gradients cause distortion in the belt, and consequently neither the upper nor the lower belt is flat. The product thus produced has areas of segregation and porosity as described below.

Leone, in the *Proceedings Of The Aluminum Association, Ingot and Continuous Casting Process Technology Seminar For Flat Rolled Products*, Vol. II, May 10, 1989, said that severe problems develop if belt stability and reasonable heat flow are not achieved. In the first place, if any area of the belt distorts after solidification of the molten metal has begun and strip shell coherency has been reached, the resulting increase in the gap between the belt and the strip in the distorted region will cause strip shell reheating, or, at least, a locally reduced shell growth rate. That, in turn, gives rise to inverse segregation in the strip which generates interdendritic eutectic exudates at the surface. Moreover, in severe cases with medium and long freezing range alloys, liquid metal is drawn away from a distorted region to feed adjacent, faster solidifying portions of the strip. That in turn causes the surface of the strip to collapse and forms massive areas of shrinkage porosity in the strip which can crack on subsequent rolling or produce severe surface streaks on the rolled surface.

As a result, twin belt casting processes have not generally achieved acceptance in the casting of alloys for surface-critical applications, such as the manufacturing of can stock. Various improvements have been proposed in the prior art, including preheating of the belts as described in U.S. Pat. Nos. 3,937,270 and 4,002,197, continuously applied and removed parting layers as described in U.S. Pat. No. 3,795,269, moving endless side dams as described in U.S. Pat. No. 4,586,559 and improved belt cooling as described in U.S. Pat. Nos. 4,061,177, 4,061,178 and 4,193,440. None of those techniques has achieved widespread acceptance either.

Another continuous casting process that has been proposed in the prior art is that known as block casting. In that technique, a number of chilling blocks are mounted adjacent to each other on a pair of opposing tracks. Each set of chilling blocks rotates in the opposite direction to form therebetween a casting cavity into which a molten metal such as an aluminum alloy is introduced. The liquid metal in contact with the chilling blocks is cooled and solidified by the heat capacity of the chilling blocks themselves. Block casting thus differs both in concept and in execution from continuous belt casting. Block casting depends on the heat transfer which can be effected by the chilling blocks. Thus, heat is transferred from the molten metal to the chilling blocks in the casting section of the equipment and then extracted on the return loop. Block casters thus require precise dimensional control to prevent flash (i.e. transverse metal fins) caused by small gaps between the blocks. Such flash causes sliver defects when the strip is hot rolled. As a result, good surface quality is difficult to maintain. Examples of such block casting processes are set forth in U.S. Pat. Nos. 4,235,646 and 4,238,248.

Another technique which has been proposed in continuous strip casting is the single drum caster. In single drum casters, a supply of molten metal is delivered to the surface of a rotating drum, which is internally water cooled, and the molten metal is dragged onto the surface of the drum to form a thin strip of metal which is cooled on contact with the surface of the drum. The strip is frequently too thin for many applications, and the free surface has poor quality by reason of slow cooling and micro-shrinkage cracks. Various improvements in such drum casters have been proposed. For example, U.S. Pat. Nos. 4,793,400 and 4,945,974 suggest grooving of the drums to improve surface quality; U.S. Pat. No. 4,934,443 recommends a metal oxide on the drum surface to improve surface quality. Various other techniques are proposed in U.S. Pat. Nos. 4,979,557, 4,828,012, 4,940,077 and 4,955,429.

Another approach which has been employed in the prior art has been the use of twin drum casters, such as in U.S. Pat. Nos. 3,790,216, 4,054,173, 4,303,181, or 4,751,958. Such devices include a source of molten metal supplied to the space between a pair of counter-rotating, internally cooled drums. The twin drum casting approach differs from the other techniques described above in that the drums exert a compressive force on the solidified metal, and thus effect hot reduction of the alloy immediately after freezing. While twin drum casters have enjoyed the greatest extent of commercial utilization, they nonetheless suffer from serious disadvantages, not the least of which is an output typically ranging about 10% of that achieved in prior art devices described above. Once again, the twin drum casting approach, while providing acceptable surface quality in the casting of high purity aluminum (e.g. foil), suffers from poor surface quality when used in the casting of aluminum with high alloy content and wide freezing range. Another problem encountered in the use of twin drum casters is center-line segregation of the alloy due to deformation during solidification.

In co-pending application Ser. No. 07/902,997 filed Jun. 23, 1992, there is described an improved method and apparatus for the continuous casting of metals, and particularly aluminum, utilizing at least one endless belt or web formed of a heat conductive material. In the method and apparatus described in that co-pending application, the disclosure of which is incorporated herein by reference, a molten metal such as aluminum is deposited on the surface of the belt to form a cast metal strip. The sensible heat of fusion of the metal is removed from the belt by means of cooling the belt when the belt is not in contact with the metal. As is described in the aforementioned co-pending application, the method and apparatus there disclosed utilizes the heat sink capacity of the belt in casting the molten metal to minimize or avoid erratic distortion effects caused by high non-uniform thermal gradients across the belt. The present invention is an improvement over the method and apparatus described in the foregoing co-pending application, and is directed to a method and apparatus for continuously cooling the endless belt in which the cooling or quenching fluid is contained so as not to contaminate the remainder of the casting process, or without the need to use complex and expensive contacting seals.

It is accordingly an object of the invention to provide a method and apparatus for continuously cooling an endless belt by means of a cooling fluid in which the temperature of the belt is accurately controlled, and, at the same time, is contained without contamination of the adjacent processes without the need to employ complex and costly seals. The casting process requires that the heat transferred from the product is extracted by quenching the belts in a controlled manner. The belt temperature at the point where molten metal is introduced must be accurately controlled because it is critical to the process, affecting the thickness of products. It is also important to the process and to product surface quality that the temperature profile over the width is controlled in incremental zones in order to maintain belt flatness and affect uniformity of thermal contact between belts and products.

The quench system when applied for quenching the product requires similar attributes of zone controlled quenching rates in order to provide successful, uniform metallurgical processing; i.e., to retain the elements in solid solution, thereby increasing strength and improving corrosion resistance.

In both applications, the quenching media must be entirely contained within the quenching devices. In the case of belt quenching, it is imperative that no trace of quenching media is allowed to enter the region of molten metal introduction for reasons of surface quality and safety. When quenching products, the finished strip must be free of moisture in order to prevent water stain.

These and other objects and advantages of the invention appear more fully hereinafter from a detailed description of the invention.

SUMMARY OF THE INVENTION

The concepts of the present invention resides in a method and apparatus for continuously cooling a moving web such as an endless belt utilizing at least one quench box positioned adjacent to a surface of the belt. The quench box includes first passage means for providing a stream of quenching fluid substantially transversely across the entire width of the belt to cool the belt. Positioned on either side of the first passage means are a pair of first containment passage means in the quench box positioned to direct a containment fluid toward the first passage means to establish continuously containment fluid curtain streams to prevent passage of the quenching fluid beyond the first containment passage means. Positioned at each web exit of the box is a gas discharge to provide means of final containment of quenching and containment fluid. The quench box also is equipped with exit discharge means to remove the quenching fluid and containment fluid from the quench box.

Thus, in the practice of the present invention, the temperature of the endless belt is accurately controlled in discrete zones by means of the quenching fluid, and that fluid is contained provided that the final web temperature exceeds the boiling point of the quenching fluid without the need to employ complex and costly sealing systems to prevent the quenching fluid from contaminating other parts of the process.

In accordance with the practice of this invention, the heated quenching fluid is removed from the surface of the belt without contamination of surrounding operations while facilitating accurate zone temperature control of the belt to minimize thermal distortions thereof.

The concepts of the present invention find particular utility in the continuous strip casting of metals, and particularly aluminum, utilizing a twin belt strip casting approach in which the belts are each cooled in an outer loop when the belt is out of contact with the molten metal as described in co-pending application Ser. No. 07/902,997.

DETAILED DESCRIPTION OF THE INVENTION

Figure 1:
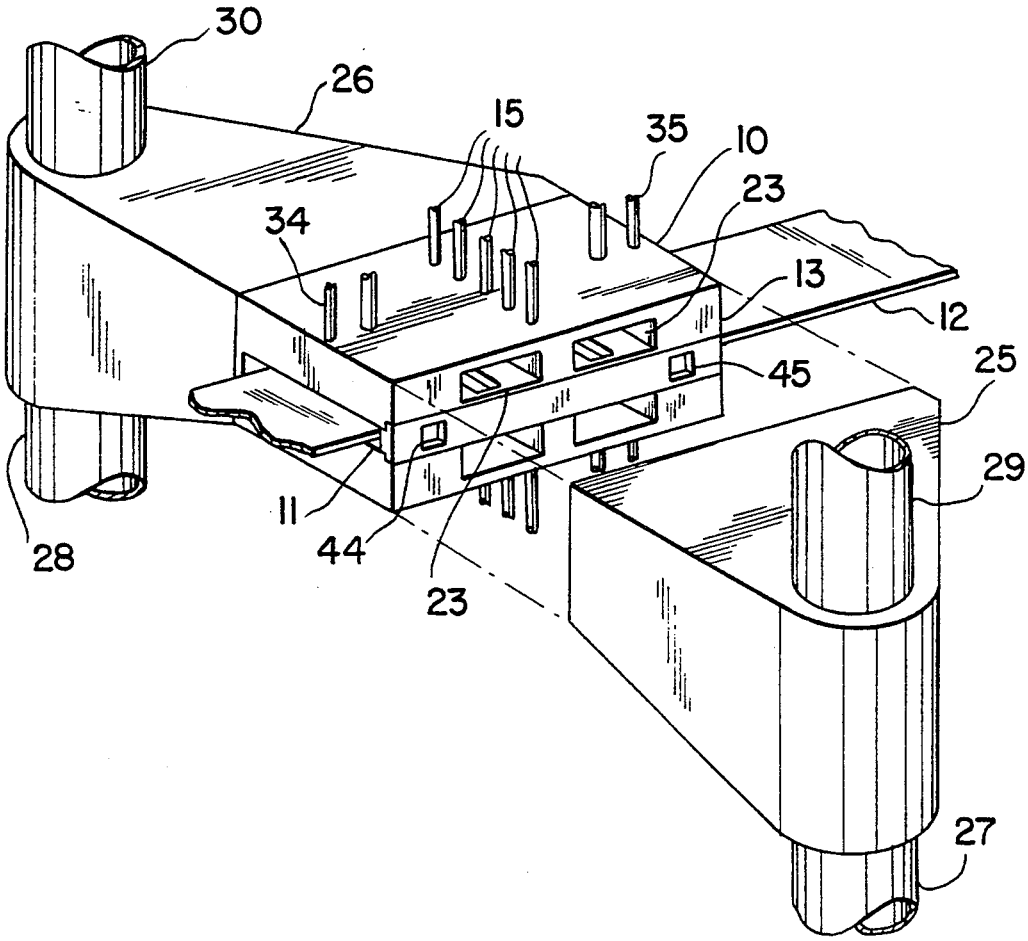
FIG. 1 is a perspective view of a quench box embodying the concepts of the present invention.

The apparatus employed in the practice of the present invention may be illustrated by reference to FIGS. 1–3. As there can be seen, the quench box 10 of the present invention includes a longitudinal opening 11 through which the web or endless belt extends. In the preferred embodiment of the invention, the quench box is positioned on both sides of an endless belt 12 with the belt passing through the longitudinal opening 11 extending through the entire quench box to permit the belt to be continuously advanced through the opening 11. The upper section 13 of the quench box 10 is equipped with a transversely extending passageway 14 through which a quenching fluid is introduced. The quenching fluid introduced to the passageway 14 thus impinges on the surface of the belt 12 to provide a cooling effect on the surface of the belt.

In the preferred practice of the invention, the quenching fluid is introduced through a series of conduits 15 to a manifold 16. In fluid communication with the manifold 16 are openings 17 in the quench box through which the quenching fluid introduced through the conduit 15 must pass from the slot 14 directly onto the surface of the belt 12.

Figure 3:
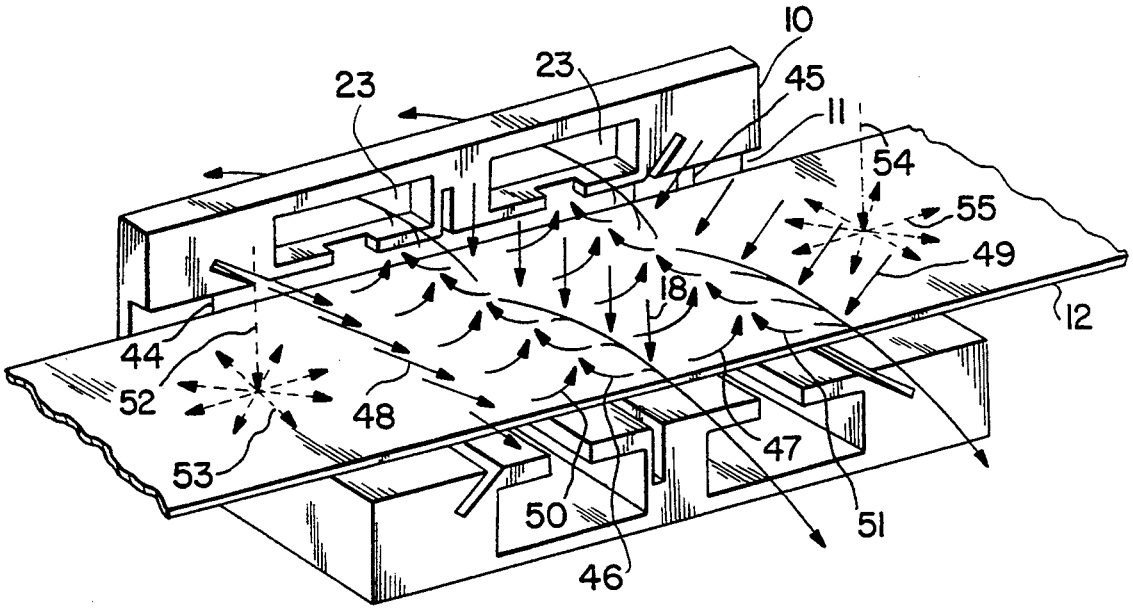
FIG. 3 is a cut away view of the quench box illustrated in FIG. 1 illustrating the flow pattern of the various fluids.

As is perhaps best illustrated in FIG. 3, the quenching fluid introduced through the conduits 15 into the manifold 14 and then through the openings 17 preferably are directed substantially perpendicular to the surface of the belt 12 as illustrated by the arrows 18.

Figure 2:
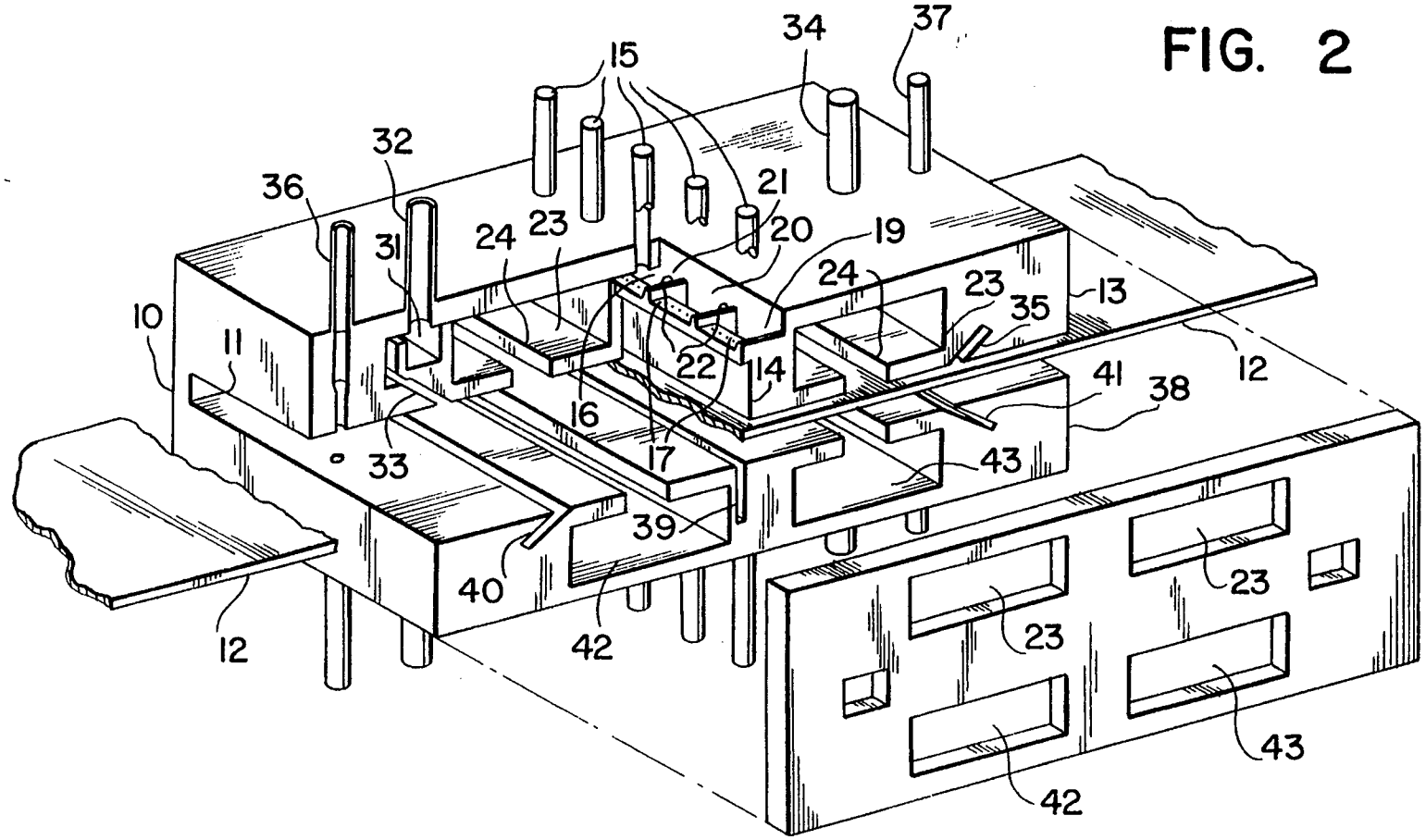
FIG. 2 is a partial cut away view of the quench box illustrated in FIG. 1.

In the most preferred embodiment of the invention, each of the conduits 15 supply separate manifolds illustrated in FIG. 2 as 19, 20, 21, etc. which are separated from each other by means of dividers or baffles 22. Thus, the first conduit 15 supplies fluid to the manifold 19 which in turn is separated from manifold 20 by means of another divider or baffle 22. In that way, the quantity and/or temperature of the quenching fluid supplied to each of the separate manifolds can be separately controlled to insure uniform cooling across the surface of the belt.

Positioned on either side of the quenching passage means 14 are a pair of transversely extending return ports 23 including a slotted opening 24 immediately above the belt 12.

The slotted opening 24 is in fluid communication with the surface of the belt, and is positioned to receive quenching fluid after it has impinged on the surface of belt 12. As is illustrated in FIG. 1, the return ports 23 are in fluid communication with return ducts 25 and 26 which in turn communicate with drain pipes 27 and 28 for delivering quenching fluid to a sump and vent pipes 29 and 30. In the preferred practice of the invention, the vent pipes are maintained at or below atmospheric pressure to relieve any gas pressure build up in the quench box and further assure containment of the quenching fluid.

Also defined by the quench box 13 is an internal manifold 31 to which a containment fluid is supplied by means of a conduit 32. The internal manifold 31 communicates with a transversely extending slotted opening 33 extending across the width of the quench box 10 and angled downwardly and inwardly toward the point where the quenching fluid impinges on the surface of the belt 12. Thus, a containment fluid introduced through the conduit 32 into the manifold 31 passes through a passage to the slotted opening 33 to establish a continuous containment fluid curtain stream toward the surface of the belt 12. That containment stream thus diverts any of the quenching fluid flowing longitudinally in the direction of the slotted opening 33 to the return ports 23 for passage to return ducts 25 and 26 and vent pipes 29 and 30.

The opposite end of the quench box 10 includes a corresponding conduit 34 which supplies a manifold not illustrated in the drawings which in turn supplies a containment fluid to a transversely extending slotted opening 35. The latter slotted opening is positioned in the opposite direction from the slotted opening 33 and likewise establishes a continuous containment fluid curtain stream toward the surface of the belt. Thus, slotted openings 33 and 35, since each is positioned on either side of the passage 14 for the quenching fluid, serve to contain the quenching fluid between slots 33 and 35 to assure that the quenching fluid does not escape longitudinally along the surface of the belt 12, and, at the same time, insures that the quenching fluid is directed to the return ports 23 for removal from the quench box without contaminating adjacent parts of the equipment.

In the most preferred embodiment of the invention, the quench box 10 also includes, at the outer extremes, a pair of vertical passages extending therethrough supplied by conduits 36 and 37.

In the preferred embodiment, a final containment fluid is passed substantially perpendicularly toward the surface of the belt 12 to insure that the quenching fluid is directed toward the center of quench box 10. For that purpose, it is generally preferred that the final containment fluid supplied to conduits 36 and 37 be a containment gas whereby a portion of the gas flow is directed toward the interior of the quench box 10, thus preventing any small amount of liquid on the surface of the belt 12 from exiting the box 10.

In the preferred practice of the invention, the quench box 10 also includes a lower section 38 which is a mirror image of the upper section 13 and includes a passage 39 to supply quenching fluid to the underside of the belt 12, and preferably through adjacent manifolds permitting separate control of the quenching fluid across the width of the belt 12. Similarly, the lower section 38 of the quench box 10 includes slotted openings 40 and 41, respectively, corresponding to slotted openings 33 and 35. Those slotted openings perform the same function of supplying a containment fluid to the underside surface of the belt 12. Similarly, the lower section 38 includes return ducts 42 and 43, respectively, which are in fluid communication with the underside of the belt to insure rapid and efficient removal of the quenching and containment fluids from the underside of the belt 12.

In the preferred embodiment of the invention, the quench box 10 is also provided with blow-off ports 44 and 45 to receive coolant removed from the web by the final containment gas supplied through conduits 36 and 37. A portion of the final containment gas introduced through conduits 36 and 37 passes along the surface of the belt 12 causing any small amount of liquid remaining on the surface of the belt to exit through blow-off ports 44 and 45 into return ducts 25 and 26 for removal from the quench box.

The flow patterns of the various fluids are illustrated in FIG. 3 of the drawings. The quenching fluid introduced through the plurality of manifolds supplied by conduits 15 impinges in a generally perpendicular fashion on the surface of the belt 12 as shown by the arrows designated as 18 in FIG. 3. The quenching fluid, which is preferably a liquid, strikes the surface of the belt 12 and then flows in both directions in a generally longitudinal manner on the surface of the belt 12 as illustrated by the arrows 46 and 47 in FIG. 3. The containment fluid introduced through slotted openings 33 and 35, illustrated by the arrows designated 48 and 49, respectively, forms a continuous curtain as a containment stream, forcing the quenched liquid toward the center of the quench box 10 for removal through return ports 23. Thus, the containment fluid, once it impinges on the surface of the belt 12, flows in a direction generally illustrated by arrows 50 and 51, forcing the quenching fluid toward the center of the quench box 10 for removal through return ports 23. The final containment gas, whose movement is illustrated by arrows 52 and 53 and 54 and 55 can impinge on the surface of the belt 12 in a substantially perpendicular manner as illustrated in the drawings. Some of the final containment gas serves to insure containment of the quenching fluid and the containment fluid. If desired, the final containment gas can be angled in a direction toward the center of the quench box 10 to increase the velocity of the containment gas in that direction and further assure that none of the quenching fluid or the containment fluid can exit the quench box 10 through the horizontal opening 11.

In the preferred practice of the invention, it is generally desirable that the quenching fluid be in the form of a liquid. For reasons of economy, water is usually preferred. Other known quenching liquids can be used at greater expense. Similarly, the containment fluid is likewise preferably a liquid. In accordance with the most preferred embodiment of the invention, the containment fluid is water as well. As the final containment gas, it is generally preferred to employ air for reasons of economy.

The quench box apparatus of the present invention is preferably employed in the cooling of the endless belt or web as described in co-pending application Ser. No. 07/902,997 referred to above. Its use in the strip casting of metals, and preferably aluminum, is illustrated in FIGS. 4 and 5 of the drawings.

Figure 4:
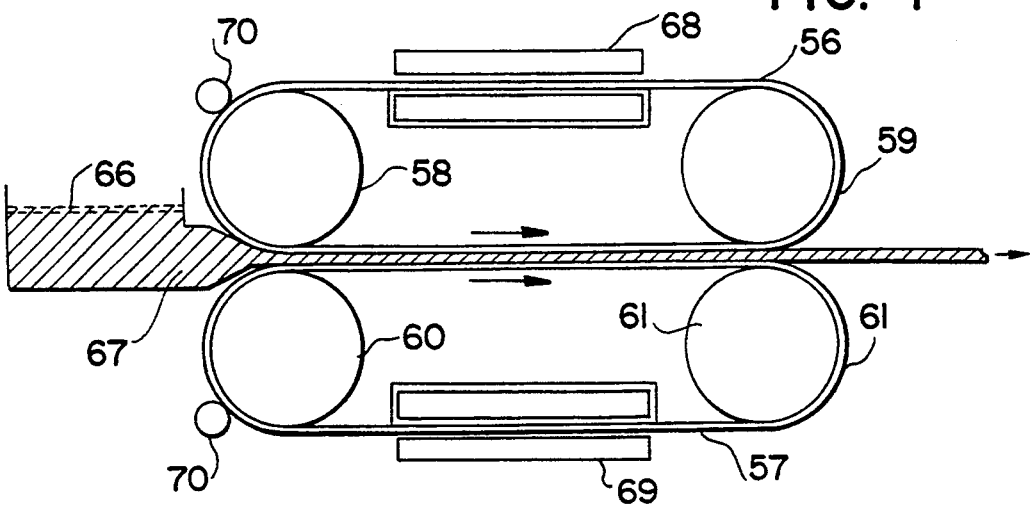
FIG. 4 is a schematic illustration of the use of the quench box of the invention in the casting of metals.

As there shown, the apparatus includes a pair of endless belts 56 and 57 carried by a pair of upper pulleys 58 and 59 and a pair of corresponding lower pulleys 60 and 61 of FIG. 4. Each pulley is mounted for rotation about an axis 62, 63, 64, and 65, respectively of FIG. 5. The pulleys are of a suitable heat resistant type, and either or both of the upper pulleys 58 and 59 is driven by a suitable motor means not illustrated in the drawing for purposes of simplicity. The same is equally true for the lower pulleys 60 and 61. Each of the belts 56 and 57 is an endless belt or web, and is preferably formed of a metal which is low or non-reactive with the metal being cast. Quite a number of suitable metal alloys may be employed as is well known by those skilled in the art. Good results have been achieved using steel and copper alloy belts.

Figure 5:
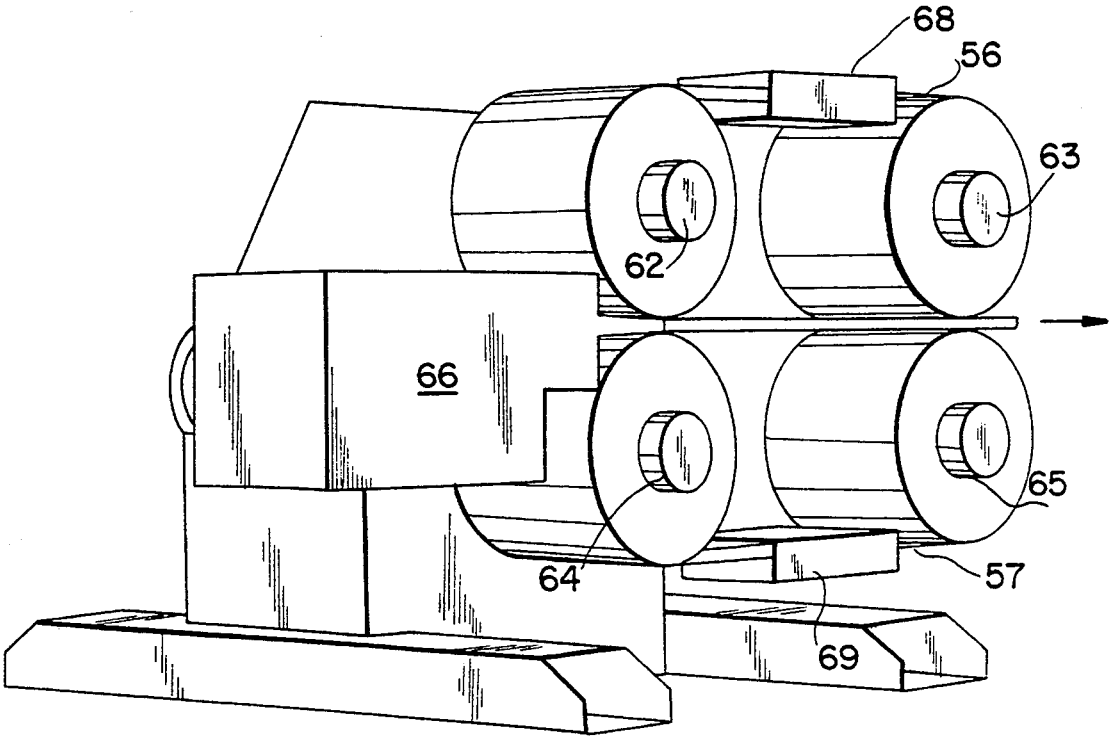
FIG. 5 is a perspective view of the casting apparatus utilizing the quench box of the present invention.

The pulleys are positioned, as illustrated in FIGS. 4 and 5, one above the other with a molding gap therebetween. In the preferred practice of the invention, the gap is dimensioned to correspond to the desired thickness of the metal strip being cast.

Molten metal to be cast is supplied to the molding gap through suitable metal supply means 66 such as a tundish. The inside of tundish 66 corresponds in width to the width of the belts 56 and 57 and includes a metal supply delivery casting nozzle 67 to deliver molten metal to the molding gap between the belts 56 and 57. Such tundishes are conventional in strip casting.

In accordance with the concepts of the invention, the casting apparatus of the invention includes a pair of quench boxes of the present invention 68 and 69 positioned opposite that portion of the endless belt in contact with the metal being cast in the molding gap between belts 56 and 57. The quench boxes thus serve to cool the belts 56 and 57 just after they pass over pulleys 59 and 61, respectively, and before they come into contact with the molten metal. In the most preferred embodiment as illustrated in FIGS. 1 and 2, the quench boxes are positioned as shown on the return run of belt 12.

In a preferred embodiment, it is sometimes desirable to employ scratch brush means 70 which frictionally engage the endless belts 56 and 57, respectively, as they pass over the pulleys 58 and 60 to clean any metal or other forms of debris from the surface of the endless belts 56 and 57 before they receive molten metal from the tundish 66.

Thus, in the practice of the invention, molten metal flows from the tundish through the casting nozzle 67 into the casting zone defined between the belts 56 and 57 and the belts 56 and 57 are heated by means of heat transfer from the cast strip to the metal of the belts. The cast metal strip remains between the casting belts 56 and 57 until each of them is turned past the centerline of pulleys 59 and 61. During the return loop, the quench boxes of the invention cool the belts 56 and 57, respectively, and substantially remove therefrom the heat transferred to the belts by means of the molten metal as it solidifies. After the belts are cleaned by the scratch brush means 70 while passing over pulleys 58 and 60, they approach each other to once again define a casting zone.

The thickness of the strip that can be cast is, as those skilled in the art will appreciate, related to the thickness of the belts 56 and 57, the return temperature of the casting belts and the exit temperature of the strip and belts. In addition, the thickness of the strip depends also on the metal being cast. It has been found that aluminum strip has a thickness of 0.100 inches using steel belts having a thickness of 0.08 inches with a return temperature of 300° F. and an exit temperature of 800° F.

The quench system of the present invention has been employed to cool a continuous web fabricated of steel having a width of 7 inches and a thickness of 0.062 inches. The web was operated at a linear speed of 196 feet per minute and was cooled using a coolant water supply of 25 psi and air as the containment gas under a pressure of 70 psi. It was found that complete containment of the water coolant was achieved in all tests.

In carrying out the tests, use was made of water flow rates through the slotted openings 33, 35, 40 and 41 (referred to as end slots) and 5 top and 5 bottom manifolds equally distributed across the width of the web (referred to as center slot zones). The total flow through all four, full width, end slots and the total flow through both top and bottom center slots in each cooling zone along with initial and final belt temperatures by zone are set forth in the following table:

| Test | WATER FLOW, GPM | | | | | | INITIAL BELT TEMP, F. | | | | | FINAL BELT TEMP, F. | | | | |
|---|---|---|---|---|---|---|---|---|---|---|---|---|---|---|---|---|
| | End | CENTER SLOT ZONES | | | | | ZONES | | | | | ZONES | | | | |
| No. | Slots | 1 | 2 | 3 | 4 | 5 | 1 | 2 | 3 | 4 | 5 | 1 | 2 | 3 | 4 | 5 |
| 1 | 8.6 | 0.0 | 0.0 | 0.0 | 0.0 | 0.0 | 532 | 554 | 576 | 541 | 506 | 465 | 484 | 502 | 520 | 466 |
| 2 | 8.5 | 2.0 | 1.8 | 1.9 | 1.9 | 1.9 | 509 | 543 | 577 | 543 | 508 | 261 | 341 | 421 | 410 | 290 |
| 3 | 8.3 | 2.0 | 2.9 | 1.4 | 2.4 | 1.7 | 624 | 665 | 706 | 668 | 630 | 415 | 487 | 559 | 586 | 521 |
| 4 | 8.3 | 1.2 | 3.9 | 3.9 | 4.0 | 1.1 | 554 | 583 | 611 | 590 | 569 | 428 | 342 | 256 | 258 | 496 |
| 5 | 7.9 | 2.1 | 4.0 | 4.1 | 4.1 | 2.0 | 638 | 664 | 689 | 670 | 651 | 473 | 386 | 299 | 365 | 490 |
| 6 | 9.6 | 1.7 | 3.8 | 3.9 | 3.9 | 1.9 | 454 | 464 | 473 | 455 | 436 | 200 | 207 | 213 | 214 | 211 |
| 7 | 8.3 | 2.8 | 4.0 | 3.6 | 3.5 | 3.5 | 634 | 673 | 711 | 686 | 660 | 399 | 410 | 421 | 479 | 335 |
| 8 | 10.1 | 3.0 | 3.5 | 3.6 | 3.6 | 3.0 | 571 | 587 | 602 | 589 | 575 | 348 | 317 | 285 | 295 | 303 |

-continued

| Test | WATER FLOW, GPM | | | | | | INITIAL BELT TEMP, F. | | | | | FINAL BELT TEMP, F. | | | | |
|---|---|---|---|---|---|---|---|---|---|---|---|---|---|---|---|---|
| | End | CENTER SLOT ZONES | | | | | ZONES | | | | | ZONES | | | | |
| No. | Slots | 1 | 2 | 3 | 4 | 5 | 1 | 2 | 3 | 4 | 5 | 1 | 2 | 3 | 4 | 5 |
| 9 | 14.3 | 4.4 | 3.8 | 4.5 | 4.5 | 4.5 | 614 | 643 | 671 | 641 | 611 | 207 | 255 | 302 | 246 | 229 |

One of the advantages of the method and apparatus of the present invention is that there is no need to employ a thermal barrier coating on the belts to reduce heat flow and thermal stress, as is typically employed in the prior art. The absence of fluid cooling on the back side of the belt while the belt is in contact with hot metal in the molding zone significantly reduces thermal gradients and eliminates problems of film boiling occurring when the critical heat flux is exceeded. The method and apparatus of the present invention also minimizes cold framing, a condition where cold belt sections exist in three locations, namely (1) before metal entry and (2) on each of the two sides of mold zone of the belt. Those conditions can cause severe belt distortion.

Figure 6:
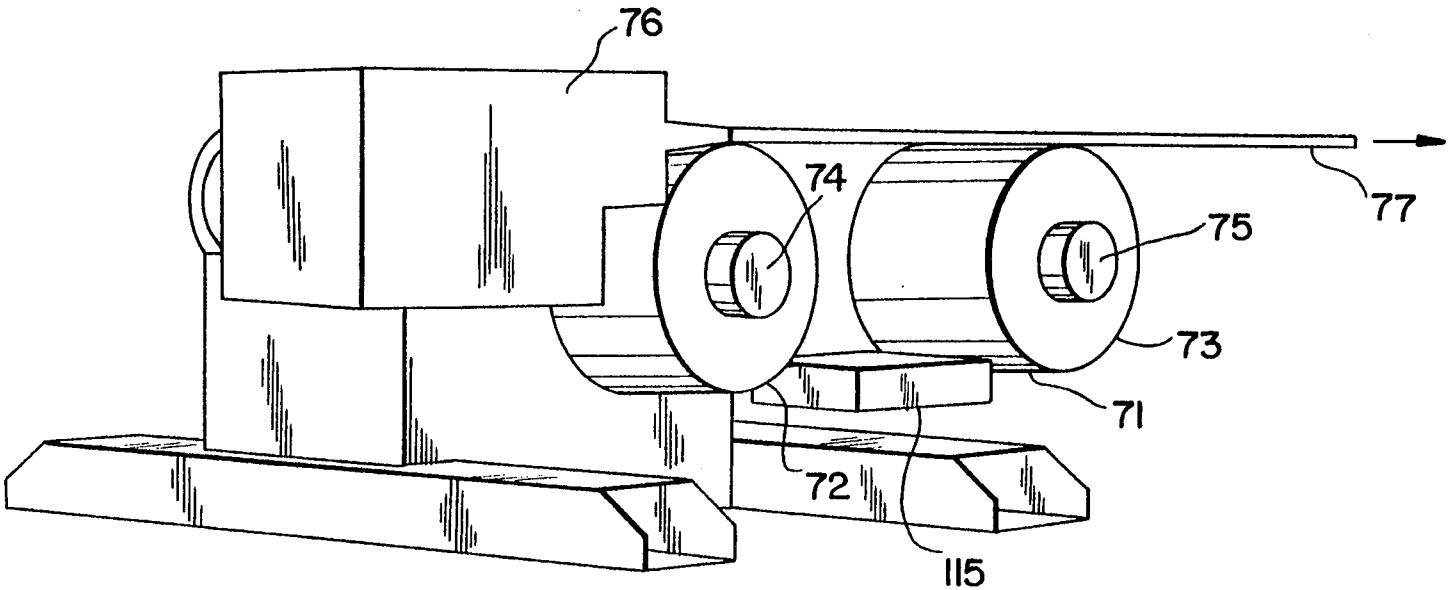
FIG. 6 is a perspective view of an alternate embodiment of the method and apparatus for casting metals utilizing the quench box of the invention.

In accordance with another embodiment of the present invention, it is also possible to employ the concepts of the present invention in a method and apparatus utilizing a single belt. That embodiment is schematically illustrated in FIG. 6 of the drawings. In that embodiment, a single belt 71 is mounted on a pair of pulleys 72 and 73, each of which is mounted for rotation about an axis 74 and 75, respectively. Molten metal is supplied to the surface of the belt by means of a tundish 76. Cast product 77 exits the top surface of belt 71. As is the case with the embodiment illustrated in FIGS. 1 and 2, the ultimate embodiment of FIG. 6 utilizes the quench box of the invention 78, preferably positioned on the return of the belt. The quench box 78, like that of the quench box in FIG. 1, serves to cool the belt when it is not in contact with the molten metal on the belt 71.

It will be understood that various changes and modifications can be made in the details of structure configuration and use without departing from the spirit of the invention, especially as defined in the following claims.

What is claimed is:

1. Apparatus for continuously cooling a moving web having opposing faces by means of a cooling fluid while removing the cooling fluid from the web comprising a quench box positioned adjacent and enveloping the web, first passage means in said quench box for providing a stream of quenching fluid substantially transversely across each face of said web to cool said web, first containment passage means in said quench box on either side of the first passage means and positioned to direct a containment fluid toward said first passage means to establish continuous containment fluid curtain streams to prevent passage of said quenching fluid longitudinally beyond said first containment passage means and exit means to remove the quenching fluid and containment fluid from the quench box.

2. Apparatus as defined in claim 1 wherein said passage means is divided into a series of zones, with each zone being separately controllable in the quenching fluid supplied to each zone.

3. Apparatus as defined in claim 2 which includes means to separately control the amount and temperature of the quenching fluid supplied to each zone.

4. Apparatus as defined in claim 1 which includes means for introducing a final containment gas, said means establishing a containment having at least one gas flow component directed toward the interior of the quench box.

5. Apparatus as defined in claim 1 wherein said first containment passage means is in the form of slot passage means positioned to direct the containment fluid toward said web at an angle.

6. Apparatus for strip casting of metals comprising at least one moving web formed of a solid heat conductive material having opposing faces, means for supplying to one surface of the web a molten metal whereby said molten metal is positioned on the web, and cooling means positioned adjacent to and enveloping the web for cooling the web when the web is not in contact with said metal, said cooling means including a quench box positioned to envelop the web, first passage means in said quench box for providing a stream of quenching fluid substantially transversely across said web to cool the faces of the web, first containment passage means in said quench box on either side of the first passage means and positioned to direct a containment fluid toward said first passage means to establish continuous containment fluid curtain streams to prevent passage of said quenching fluid longitudinally beyond said first containment passage means and exit means to remove the quenching fluid and containment fluid from the quench box.

7. Apparatus as defined in claim 6 which includes a pair of webs, one positioned above the other to define a molding cavity therebetween.

8. Apparatus as defined in claim 7 wherein each web is carried on a pair of pulleys, each mounted for rotation.

9. Apparatus as defined in claim 8 which includes means for advancing each of said webs about the pulleys.

10. Apparatus as defined in claim 6 wherein the means for supplying molten metal includes tundish means having a nozzle positioned to deposit molten metal on the surface of said web.

11. Apparatus for continuously cooling a moving web by means of a cooling fluid while removing the cooling fluid from the web comprising a quench box positioned adjacent and enveloping the web, first passage means in said quench box for providing a stream of quenching fluid substantially transversely across said web to cool said web, first containment passage means in said quench box on either side of the first passage means and positioned to direct a containment fluid toward said first passage means to establish continuous containment fluid curtain streams to prevent passage of said quenching fluid longitudinally beyond said first containment passage means, means for introducing a final containment gas to establish a containment gas flow having at least one component directed toward the interior of the quench box and exit means to remove the quenching fluid and containment fluid from the quench box.

12. Apparatus for strip casting of metals comprising at least one moving web formed of a solid heat conductive material having opposing faces, means for supplying to one face of the web a molten metal whereby said molten metal is positioned on the web, and cooling means positioned adjacent to the web for cooling the web when the web is not in contact with said metal, said cooling means including a quench box positioned adjacent and enveloping the web, first passage means in said quench box for providing a stream of quenching fluid substantially transversely across said web to cool each face of said web, first containment passage means in said quench box on either side of the first passage means and positioned to direct a containment fluid toward said first passage means to establish continuous containment fluid curtain stream to prevent passage of said quenching fluid longitudinally beyond said first containment passage means, means for introducing a final containment gas to establish a containment gas flow having at least one component directed toward the interior of the quench box and exit means to remove the quenching fluid and containment fluid from the quench box.

13. A method for continuously cooling a moving web having opposing faces by a cooling fluid while removing the cooling fluid from the web comprising the steps of directing a stream of quenching fluid substantially transversely across each face of the web to cool the web, simultaneously directing a first containment fluid toward the quenching fluid to establish a continuous containment fluid curtain stream to prevent passage of the quenching fluid and to direct the quenching fluid toward an exit.

14. A method as defined in claim 13 which includes the step of simultaneously directing a containment gas stream having at least one component directed toward the quenching fluid to ensure that the quenching fluid is contained.

15. A method for the casting of metals comprising continuously moving at least one web having opposing surfaces, depositing on one surface of the web a molten metal to solidify on the web and form a thin strip of metal, directing a stream of quenching fluid substantially transversely across both surfaces of the web to cool the web, simultaneously directing a first containment fluid toward the quenching fluid to establish a continuous containment fluid curtain stream to prevent passage of the quenching fluid and to direct the quenching fluid toward an exit.

16. A method as defined in claim 15 in which the metal is aluminum.

17. A method as defined in claim 13 in which the web is an aluminum web.

18. Apparatus as defined in claim 1 in which the web is formed of aluminum.

* * * * *